US006202233B1

(12) United States Patent
Achong

(10) Patent No.: US 6,202,233 B1
(45) Date of Patent: Mar. 20, 2001

(54) SLEEPING BAG PILLOW

(76) Inventor: David Angus Achong, 18 Concklin Ave., Brooklyn, NY (US) 11236

( * ) Notice: Subject to any disclaimer, the term of this patent is extended or adjusted under 35 U.S.C. 154(b) by 0 days.

(21) Appl. No.: 09/415,004

(22) Filed: Oct. 8, 1999

(51) Int. Cl.[7] ..... A47G 9/10; A47G 9/08

(52) U.S. Cl. ..... 5/636; 5/640; 5/413 R; 5/733

(58) Field of Search ..... 5/413 R, 413 AM, 5/419, 636, 640, 643, 900.5, 490, 733

(56) References Cited

U.S. PATENT DOCUMENTS

| | | | | |
|---|---|---|---|---|
| 831,733 | * | 9/1906 | Moore | 5/413 R |
| 867,464 | * | 10/1907 | Abbott | 5/413 R |
| 1,130,116 | * | 3/1915 | Stevenson | 5/413 R |
| 3,648,308 | * | 3/1972 | Greenawalt | 5/633 X |
| 3,828,377 | * | 8/1974 | Eary, Sr. | 5/643 |
| 4,193,150 | * | 3/1980 | Vineberg | 5/900.5 |
| 4,575,884 | * | 3/1986 | Jamerson et al. | 5/413 AM |
| 4,924,543 | * | 5/1990 | Hoss et al. | 5/490 X |
| 5,005,235 | * | 4/1991 | Huang | 5/413 R |
| 5,101,823 | * | 4/1992 | Smith | 5/419 X |
| 5,110,219 | * | 5/1992 | Lopes | 5/419 X |
| 5,392,477 | * | 2/1995 | Wolter et al. | 5/413 AM |

* cited by examiner

*Primary Examiner*—Michael F. Trettel

(57) ABSTRACT

A sleeping bag pillow for providing a comfortable pillow which easily attachable to a sleeping bag. The sleeping bag pillow includes a padded member having a bottom side, a tapered top side, tapered right and left sides, and a back side, and further includes a cover made essentially of waterproof material and adapted to enclose about the padded member, and also includes either a plurality of strips of hook and loop fasteners attached to the cover on the bottom side of the padded member or a sheet of material fastened about the sleeping bag pillow with zippers.

7 Claims, 3 Drawing Sheets

SLEEPING BAG PILLOW

BACKGROUND OF THE INVENTION

1. Field of the Invention

The present invention relates to a pillow adapted to be attachable to a sleeping bag and more particularly pertains to a new sleeping bag pillow for providing a comfortable pillow which is easily attachable to a sleeping bag.

2. Description of the Prior Art

The use of a pillow adapted to be attachable to a sleeping bag is known in the prior art. More specifically, a pillow adapted to be attachable to a sleeping bag heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,896,387; U.S. Pat. No. 4,847,931; U.S. Pat. No. Des. 325,839; U.S. Pat. No. 5,005,235; U.S. Pat. No. 5,152,017; and U.S. Pat. No. 5,050,256.

While these devices fulfill their respective, particular objectives and requirements, the aforementioned patents do not disclose a new sleeping bag pillow. The inventive device includes a padded member having a bottom side, a tapered top side, tapered right and left sides, and a back side, and further includes a cover made essentially of waterproof material and adapted to enclose about the padded member, and also includes either a plurality of strips of hook and loop fasteners attached to the cover on the bottom side of the padded member or a sheet of material fastened about the sleeping bag pillow with zippers.

In these respects, the sleeping bag pillow according to the present invention substantially departs from the conventional concepts and designs of the prior art, and in so doing provides an apparatus primarily developed for the purpose of providing a comfortable pillow which easily attachable to a sleeping bag.

SUMMARY OF THE INVENTION

In view of the foregoing disadvantages inherent in the known types of a pillow adapted to be attachable to a sleeping bag now present in the prior art, the present invention provides a new sleeping bag pillow construction wherein the same can be utilized for providing a comfortable pillow which easily attachable to a sleeping bag.

The general purpose of the present invention, which will be described subsequently in greater detail, is to provide a new sleeping bag pillow apparatus and method which has many of the advantages of a pillow adapted to be attachable to a sleeping bag mentioned heretofore and many novel features that result in a new sleeping bag pillow which is not anticipated, rendered obvious, suggested, or even implied by any of the prior art a pillow adapted to be attachable to a sleeping bag, either alone or in any combination thereof.

To attain this, the present invention generally comprises a padded member having a bottom side, a tapered top side, tapered right and left sides, and a back side, and further includes a cover made essentially of waterproof material and adapted to enclose about the padded member, and also includes either a plurality of strips of hook and loop fasteners attached to the cover on the bottom side of the padded member or a sheet of material fastened about the sleeping bag pillow with zippers.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sleeping bag pillow apparatus and method which has many of the advantages of a pillow adapted to be attachable to a sleeping bag mentioned heretofore and many novel features that result in a new sleeping bag pillow which is not anticipated, rendered obvious, suggested, or even implied by any of the prior art a pillow adapted to be attachable to a sleeping bag, either alone or in any combination thereof.

It is another object of the present invention to provide a new sleeping bag pillow which may be easily and efficiently manufactured and marketed.

It is a further object of the present invention to provide a new sleeping bag pillow which is of a durable and reliable construction.

An even further object of the present invention is to provide a new sleeping bag pillow which is susceptible of a low cost of manufacture with regard to both materials and labor, and which accordingly is then susceptible of low prices of sale to the consuming public, thereby making such sleeping bag pillow economically available to the buying public.

Still yet another object of the present invention is to provide a new sleeping bag pillow which provides in the apparatuses and methods of the prior art some of the advantages thereof, while simultaneously overcoming some of the disadvantages normally associated therewith.

Still another object of the present invention is to provide a new sleeping bag pillow for providing a comfortable pillow which easily attachable to a sleeping bag.

Yet another object of the present invention is to provide a new sleeping bag pillow which includes a padded member having a bottom side, a tapered top side, tapered right and left sides, and a back side, and further includes a cover made essentially of waterproof material and adapted to enclose about the padded member, and also includes either a plurality of strips of hook and loop fasteners attached to the cover on the bottom side of the padded member or a sheet of material fastened about the sleeping bag pillow with zippers.

Still yet another object of the present invention is to provide a new sleeping bag pillow that adds comfort, convenience, effectiveness, portability, light weight, compact size, and practicality.

Even still another object of the present invention is to provide a new sleeping bag pillow that allows the user to sleep in a more comfortable position when using the sleeping bag.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
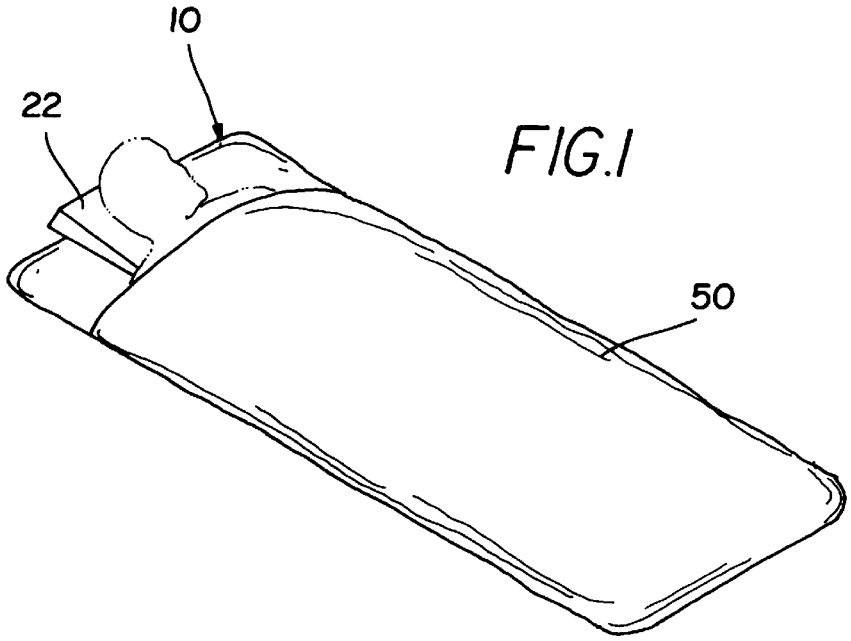
FIG. 1 is a perspective view of a new sleeping bag pillow according to the present invention.
Figure 2:
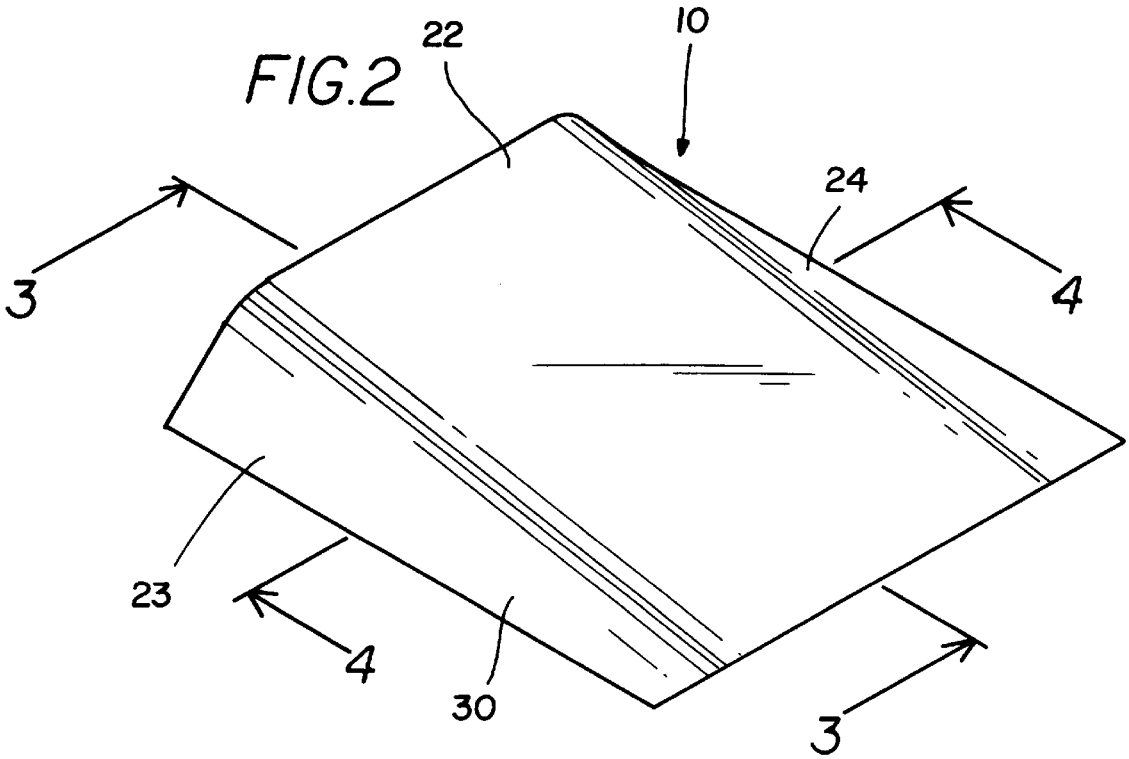
FIG. 2 is a perspective view of the present invention.
Figure 3:
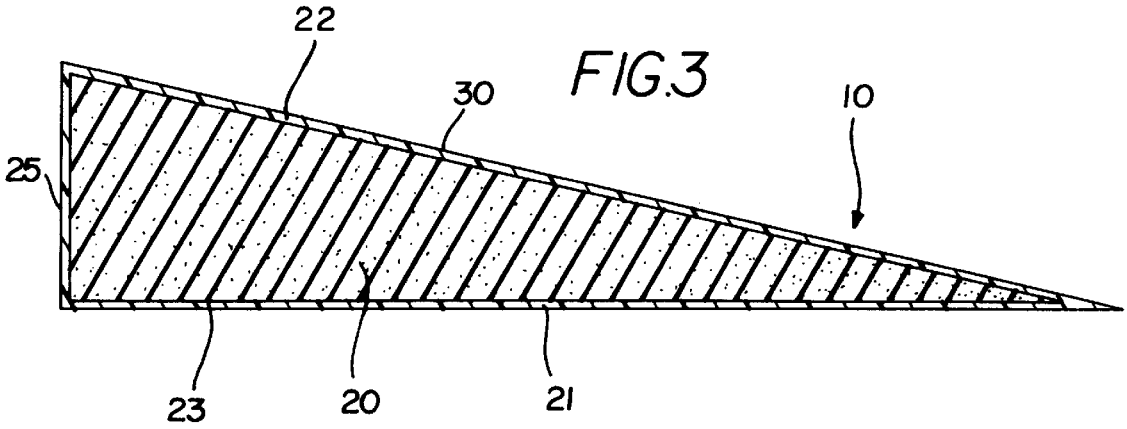
FIG. 3 is a side elevational view of the present invention.
Figure 4:
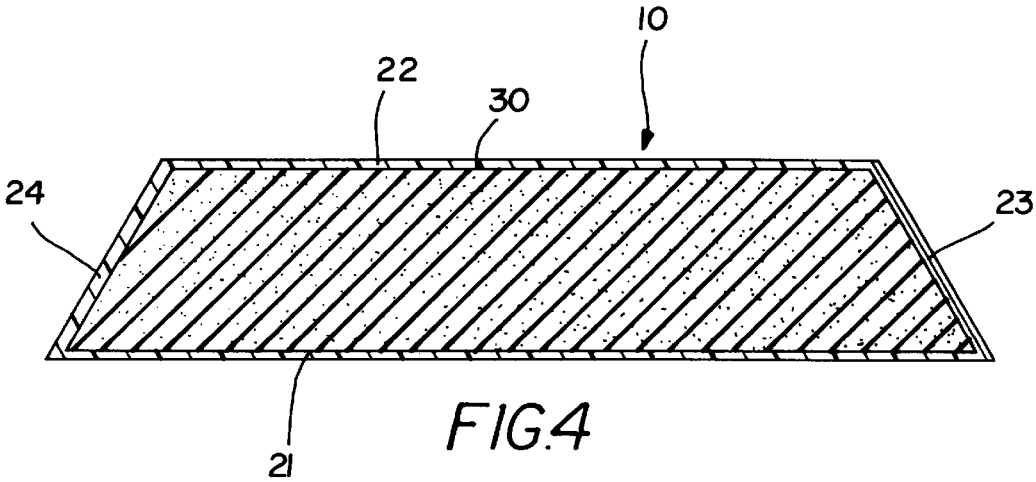
FIG. 4 is a rear elevational view of the present invention.
Figure 5:
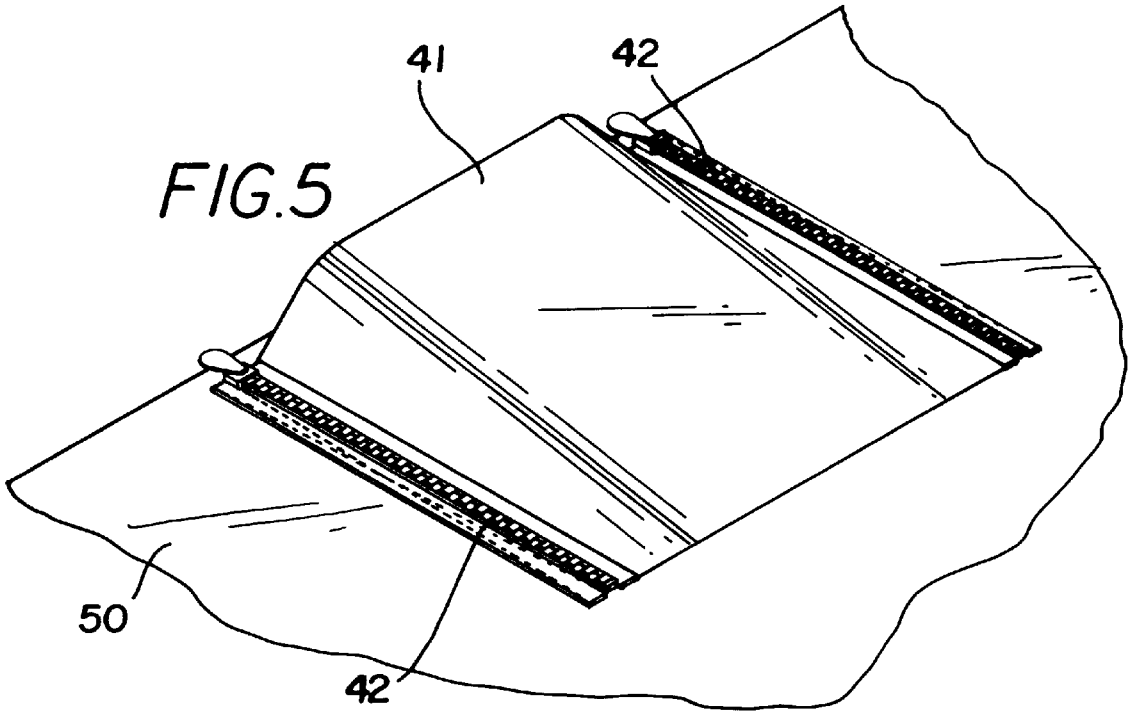
FIG. 5 is a perspective view of a second embodiment of the present invention.
Figure 6:
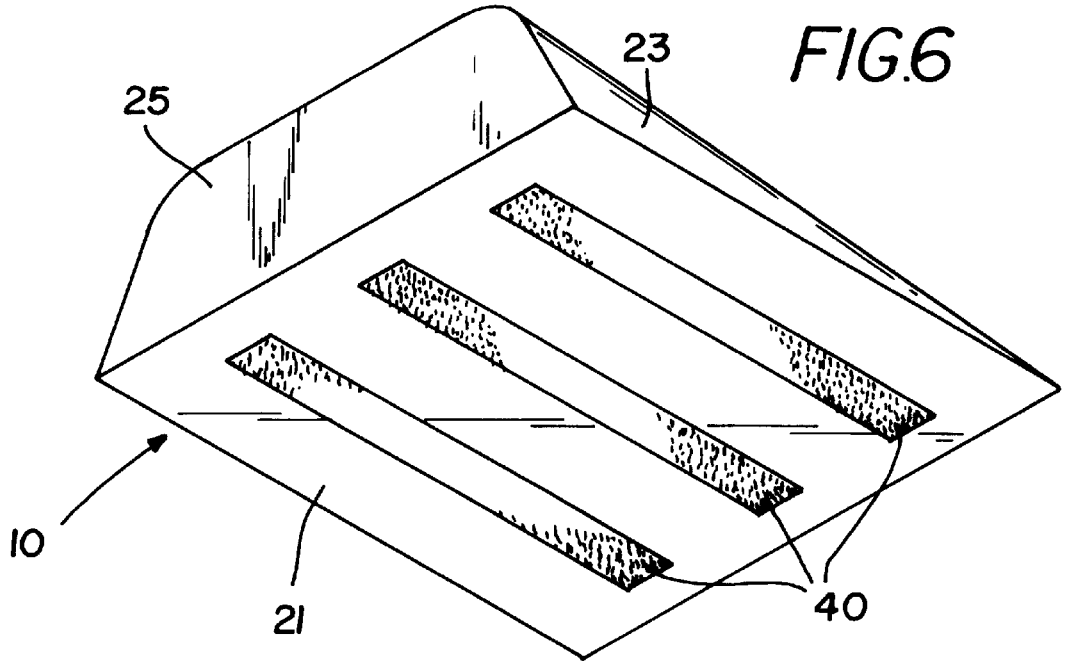
FIG. 6 is a perspective view of a first embodiment of the present invention.

With reference now to the drawings, and in particular to FIGS. 1 through 6 thereof, a new sleeping bag pillow embodying the principles and concepts of the present invention and generally designated by the reference numeral 10 will be described.

As best illustrated in FIGS. 1 through 6, the sleeping bag pillow 10 generally comprises a padded member 20 having a bottom side 21, a top side 22, left 23 and right sides 24, and a back side 25 and measuring approximately 1½ feet wide. The top side 22 is tapered downwardly from the back side 25 to the bottom side 21 with the left 23 and right sides 24 of the padded member 20 being tapered downwardly and outwardly from the top side 22 to the bottom side 21. Each of the left and right sides 23,24 has a laterally rounded upper portion. A cover member 30 made of conventional water proof material is enclosed about the padded member 20. The sleeping bag pillow 10 is secured to a sleeping bag 50 with a plurality of strips of hook and loop fastener members 40 securely attached to the cover 30. As an alternate embodiment, the sleeping bag pillow 10 is secured to a sleeping bag 50 with a sheet of material 41 and at least one fastening member 42 securely and conventionally attached thereto and being adapted to secure the sheet of material 41 to a sleeping bag 50 and about the sleeping bag pillow 10.

In use, the sleeping bag pillow 10 is attached to the sleeping bag 50 with the back side 25 of the padded member 20 being disposed near an end of the sleeping bag 50 such that the user would lie upon the sleeping bag pillow 10 with his/her head near the back side 25 of the padded member 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sleeping bag pillow comprising:

a padded member having a bottom side, a top side, left and right sides, and a back side;

a cover member enclosed about said padded member;

a means for securing said sleeping bag pillow to a sleeping bag;

wherein said top side is tapered downwardly from said back side to said bottom side; and wherein said left and right sides of said padded member are tapered downwardly and outwardly from said top side to said bottom side.

2. A sleeping bag pillow as described in claim 1, wherein each of said left and right sides has a laterally rounded upper portion.

3. A sleeping bag pillow as described in claim 1, wherein said means for securing said sleeping bag pillow to a sleeping bag includes a plurality of strips of hook and loop fastener members securely attached to said cover.

4. A sleeping bag pillow as described in claim 1, wherein said means for securing said sleeping bag pillow to a sleeping bag includes a sheet of material and at least one fastening member securely attached thereto and being adapted to secure said sheet of material to a sleeping bag and about said sleeping bag pillow.

5. A sleeping bag pillow as described in claim 4, wherein said at least one fastening member being a zipper means.

6. A sleeping bag pillow as described in claim 1, wherein:

each of said left and right sides having a laterally rounded upper portion; and said means for securing said sleeping bag pillow to a sleeping bag including a plurality of strips of hook and loop fastener members securely attached to said cover.

7. A sleeping bag pillow comprising:

a padded member having a bottom side, a top side, left and right sides, and a back side, said top side being tapered downwardly from said back side to said bottom side, said left and right sides of said padded member being tapered downwardly and outwardly from said top side to said bottom side, each of said left and right sides having a laterally rounded upper portion;

a cover member enclosed about said padded member; and a means for securing said sleeping bag pillow to a sleeping bag, said means for securing said sleeping bag pillow to a sleeping bag including a sheet of material and at least one fastening member securely attached thereto and being adapted to secure said sheet of material to a sleeping bag and about said sleeping bag pillow.

* * * * *